US006746001B1

(12) United States Patent
Sherikar

(10) Patent No.: US 6,746,001 B1
(45) Date of Patent: Jun. 8, 2004

(54) DESUPERHEATER NOZZLE

(75) Inventor: Sanjay V. Sherikar, Mission Viejo, CA (US)

(73) Assignee: Control Components, Inc., Rancho Santa Margarita, CA (US)

( * ) Notice: Subject to any disclaimer, the term of this patent is extended or adjusted under 35 U.S.C. 154(b) by 0 days.

(21) Appl. No.: 10/375,965

(22) Filed: Feb. 28, 2003

(51) Int. Cl.[7] ..... B01F 3/04

(52) U.S. Cl. ..... 261/62; 122/487; 137/542; 239/439; 261/118; 261/DIG. 13

(58) Field of Search ..... 261/62, 118, DIG. 13; 122/487; 239/439, 440; 137/542

(56) References Cited

U.S. PATENT DOCUMENTS

| | | | | | |
|---|---|---|---|---|---|
| 355,250 | A | * | 12/1886 | Blass | 261/62 |
| 1,313,971 | A | * | 8/1919 | Wilson | 261/118 |
| 2,313,994 | A | * | 3/1943 | Grant | 239/440 |
| 2,355,458 | A | * | 8/1944 | Mastenbrook | 261/DIG. 13 |
| 2,801,087 | A | * | 7/1957 | Hawk | 261/62 |
| 3,220,710 | A | * | 11/1965 | Forster | 261/DIG. 13 |
| 3,286,935 | A | * | 11/1966 | Corlett et al. | 239/440 |
| 3,331,590 | A | * | 7/1967 | Battenfeld et al. | 261/DIG. 13 |
| 3,332,401 | A | * | 7/1967 | Lustenader | 261/DIG. 13 |
| 3,732,851 | A | | 5/1973 | Self | 122/487 |
| 4,071,586 | A | * | 1/1978 | Seger | 122/487 X |
| 4,082,224 | A | * | 4/1978 | Mangus | 137/542 X |
| 4,130,611 | A | * | 12/1978 | Brand | 261/118 X |
| 4,442,047 | A | | 4/1984 | Johnson | 261/66 |
| 4,479,908 | A | * | 10/1984 | Arbeille et al. | 261/62 |
| 4,512,520 | A | | 4/1985 | Schoonover | 239/440 |
| 4,944,460 | A | * | 7/1990 | Steingass | 239/439 X |
| 5,336,451 | A | | 8/1994 | Lovick | 261/116 |
| 5,385,121 | A | | 1/1995 | Feiss | 122/459 |
| 5,607,626 | A | | 3/1997 | Kunkle et al. | 261/27 |

FOREIGN PATENT DOCUMENTS

| | | | | |
|---|---|---|---|---|
| DE | 3713726 | * | 11/1988 | 122/487 |

* cited by examiner

*Primary Examiner*—Richard L. Chiesa
(74) *Attorney, Agent, or Firm*—Stetina Brunda Garred & Brucker

(57) ABSTRACT

An improved nozzle assembly for spraying cooling water into superheated steam flowing through a steam pipe of a steam desuperheater includes a nozzle housing, a nozzle barrel, a valve element, and at least one valve spring. A nozzle barrel disposed within the nozzle housing has flow passages in fluid communication with a barrel chamber. The barrel chamber minimizes a tendency for cooling water to enter the superheated steam in a streaming spray. The valve element is slidable within the nozzle barrel for regulating the flow of cooling water through the nozzle assembly. The valve spring biases the valve element against the forward end of the nozzle housing to initially seal the nozzle assembly in a closed position. A control valve increases the fluid pressure within the nozzle housing which in turn forces the valve head away from the nozzle housing, allowing for increased flow of cooling water into the superheated steam.

15 Claims, 6 Drawing Sheets

DESUPERHEATER NOZZLE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention pertains generally to steam desuperheaters and, more particularly, to a nozzle assembly for a steam desuperheater for reducing steam temperature by spraying cooling water into a steam flow.

Many industrial facilities operate with superheated steam that has a higher temperature than its saturation temperature at a given pressure. Because superheated steam can damage turbines or other downstream components, it is necessary to control the temperature of the steam. Desuperheating refers to the process of reducing the temperature of the superheated steam to a lower temperature, permitting operation of the system as intended, ensuring system protection, and correcting for unintentional amounts of superheat.

A steam desuperheater can lower the temperature of superheated steam by spraying cooling water into a flow of superheated steam that is passing through a steam pipe. Once the cooling water is sprayed into the flow of superheated steam, the cooling water mixes with the superheated steam and evaporates, drawing thermal energy from the steam and lowering its temperature. If the cooling water is sprayed into the superheated steam pipe as very fine water droplets or mist, then the mixing of the cooling water with the superheated steam is more uniform through the steam flow. On the other hand, if the cooling water is sprayed into the superheated steam pipe in a streaming pattern, then the evaporation of the cooling water is greatly diminished. In addition, a streaming spray of cooling water will pass through the superheated steam flow and impinge on the opposite side of the steam pipe, resulting in water buildup. This water buildup can cause erosion and thermal stresses in the steam pipe that may lead to structural failure. However, if the surface area of the cooling water spray that is exposed to the superheated steam is large, then the effectiveness of the evaporation is greatly increased.

In addition, the mixing of the cooling water with the superheated steam can be enhanced by spraying the cooling water into the steam pipe in a uniform geometrical flow pattern such that the effects of the cooling water are uniformly distributed throughout the steam flow. Likewise, a non-uniform spray pattern of cooling water will result in an uneven and poorly controlled temperature reduction throughout the flow of the superheated steam. Furthermore, the inability of the cooling water spray to efficiently evaporate in the superheated steam flow may also result in an accumulation of cooling water within the steam pipe. The accumulation of this cooling water will eventually evaporate in a non-uniform heat exchange between the water and the superheated steam, resulting in a poorly controlled temperature reduction.

Various desuperheater devices have been developed to overcome these problems. One such prior art desuperheater device attempts to avoid these problems by spraying cooling water into the steam pipe at an angle to avoid impinging the walls of the steam pipe. However, the construction of this device is complex with many parts such that the device has a high construction cost. Another prior art desuperheater device utilizes a spray tube positioned in the center of the steam pipe with multiple nozzles and a moving plug or slide member uncovering an increasing number of nozzles. Each of the nozzles is in fluid communication with a cooling water source. Although this desuperheater device may eliminate the impingement of the cooling water spray on the steam pipe walls, such a device is necessarily complex, costly to manufacture and install and requires a high degree of maintenance after installation.

As can be seen, there exists a need in the art for a desuperheater device for spraying cooling water into flow of superheated steam that is of simple construction with relatively few components requiring low maintenance. Furthermore, there exists a need in the art for a desuperheater device capable of spraying cooling water in a fine mist with very small droplets for more effective evaporation. Finally, there exists a need in the art for a desuperheater device capable of spraying cooling water in a geometrically uniform flow pattern for more even mixing throughout the flow of superheated steam.

BRIEF SUMMARY OF THE INVENTION

The present invention specifically addresses and alleviates the above referenced deficiencies associated with steam desuperheaters. More particularly, the present invention is an improved nozzle assembly for a steam desuperheater that is configured to spray cooling water into a flow of superheated steam in a geometrically uniform spray pattern. The nozzle assembly has a forward and an aft end and comprises a nozzle housing, a valve element, and at least one valve spring. The nozzle housing has a hollow configuration open at the forward and aft ends. Importantly, a nozzle barrel disposed within the nozzle housing has an open annular barrel chamber disposed near the forward end of the nozzle to minimize or eliminate a tendency for the cooling water to enter the superheated steam in a streaming spray. The barrel chamber housing may further be configured with a maximum of three flow passages in the barrel chamber to provide a flow of the cooling water from the aft to the forward end of the nozzle housing. By limiting the number of flow passages to three, the tendency for the cooling water to exit the nozzle assembly in a streaming spray is further reduced.

The valve element is slidable within the nozzle barrel such that when the valve element is displaced away from the forward end of the nozzle housing, a flow orifice is created through which the cooling water may flow. The valve element has a valve head configured in a truncated conical shape for imparting a conical spray pattern to the cooling water as it exits the nozzle assembly. The valve element regulates the flow of cooling water through the flow orifice. The valve spring is operatively engaged to the valve element and biases the valve element against the forward end of the nozzle housing to initially seal the nozzle assembly in a closed position. A control valve of the superheater device increases the fluid pressure within the nozzle housing which in turn opens the nozzle assembly by forcing the valve head away from the nozzle housing, allowing for the flow of cooling water into the superheated steam.

A layer of screen mesh may be disposed at the forward end of the nozzle barrel. The screen mesh introduces a fine turbulence into the flow of cooling water through the nozzle barrel, thereby assisting in the formation of droplets. A swirl barrel may be substituted for the nozzle barrel in the nozzle housing. The swirl barrel imparts a spiral motion to the cooling water prior to discharge out of the flow orifice into the superheated steam flow so that the cooling water enters the steam flow in a swirling cone-shaped mist. The geometrically uniform mist pattern ensures a thorough and uniform mixing of the cooling water with the steam flow. The uniform mist pattern also maximizes the surface area of the cooling water spray and thus optimizes the desuperheating effect per unit mass of cooling water. A fracture ring may also be disposed at the forward end of the nozzle housing to aid in the reduction of the water droplet size of the cooling water. The fracture ring is positioned forward of the nozzle housing such that the flow of cooling water spray exiting the nozzle housing impacts the fracture ring, further reducing the droplet size.

BRIEF DESCRIPTION OF THE DRAWINGS

These, as well as other features of the present invention, will become more apparent upon reference to the drawings wherein.

DETAILED DESCRIPTION OF THE INVENTION

The present invention will now be described in particular with reference to the accompanying drawings.

Figure 1:
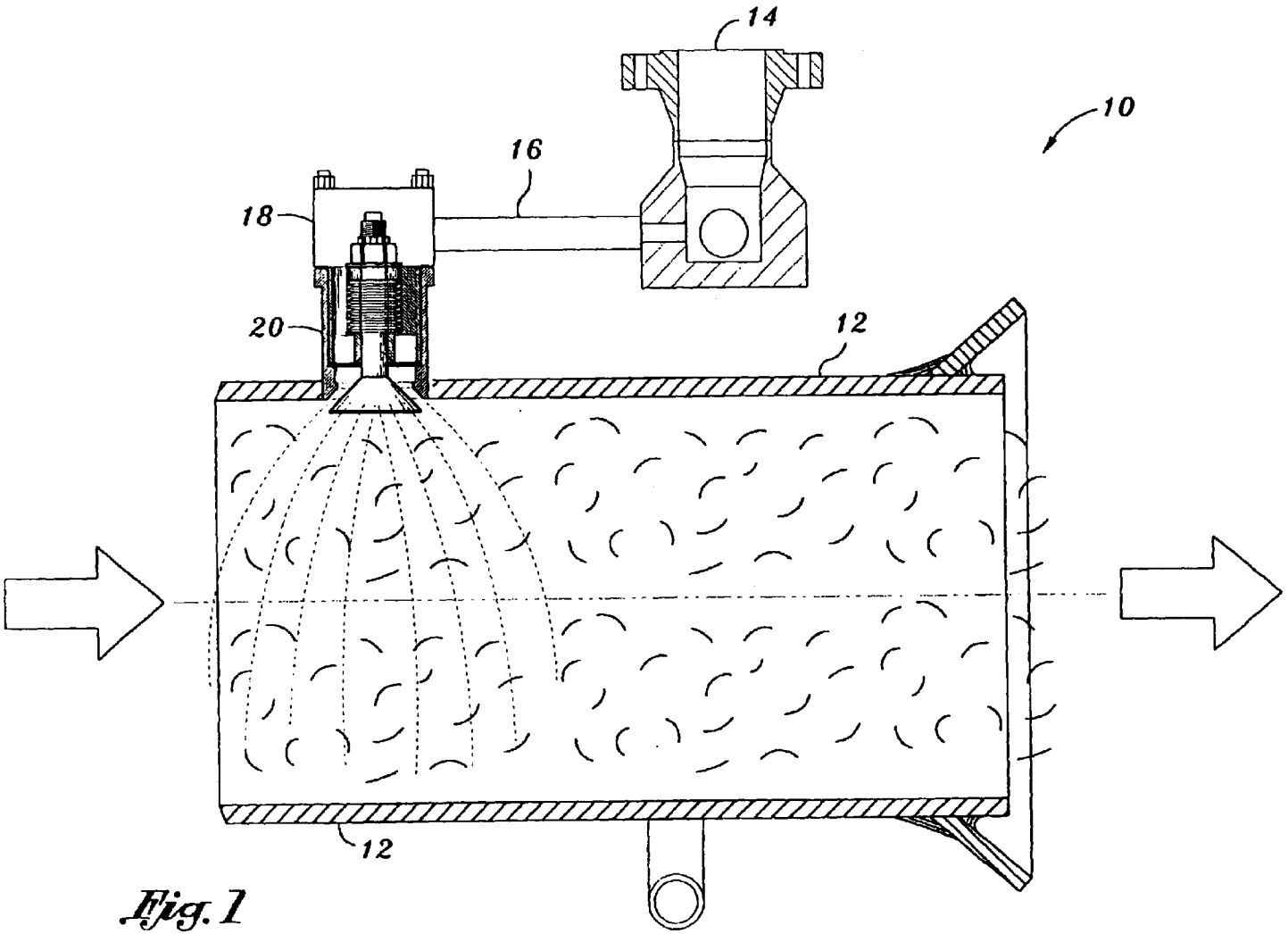
FIG. 1 is a longitudinal sectional view of a desuperheater device incorporating a nozzle assembly of the present invention.

FIG. 1 is longitudinal sectional view of a desuperheater device 10 incorporating a nozzle assembly 20 of the present invention. As can be seen in FIG. 1, a flow of desuperheating steam at elevated pressure passes through a steam pipe 12 to which the nozzle assembly 20 is attached by suitable means such as welding or the like. A nozzle holder 18 joins a cooling water feedline 16 to the nozzle assembly 20 for providing a suitable supply of cooling water thereto. The cooling water feedline 16 is connected to a cooling water control valve 14. The cooling water control valve 14 may be fluidly connected to a suitable high pressure water supply (not shown). The control valve 14 may operate to control the flow of cooling water into the cooling water feedline 16 in response to a temperature sensor (not shown) mounted in the steam pipe 12 downstream of the nozzle assembly 20. The control valve 14 may vary the water flow through the cooling water feedline 16 in order to produce varying water pressure in the nozzle assembly 20. When the cooling water pressure in the nozzle assembly 20 is greater than the elevated pressure of the superheated steam in the steam pipe 12, the nozzle assembly 20 provides a spray of cooling water into the steam pipe 12 thereby reducing the superheated steam temperature. Although FIG. 1 shows a single nozzle assembly 20 connected to the steam pipe 12, it is contemplated that there may be any number of nozzle assemblies 20 spaced around the circumference of the steam pipe 12 for optimizing the efficiency of the desuperheater device 10. Each nozzle assembly 20 may be connected via the cooling water feedline 16 to a manifold (not shown) circling the steam pipe 12 and connected to the cooling water control valve 14.

Figure 2B:
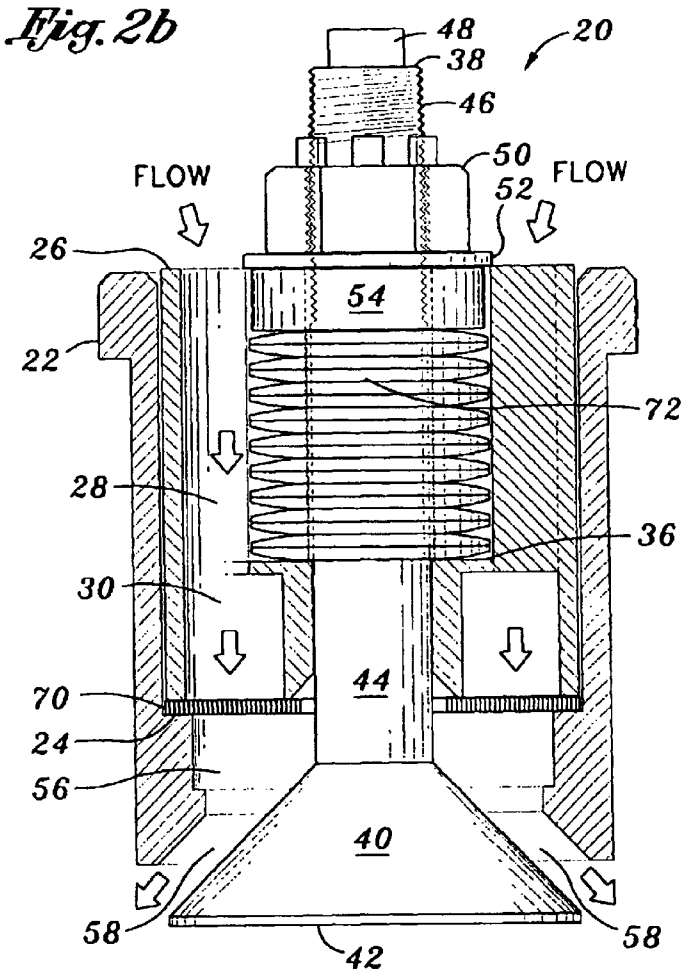
FIG. 2*b* is a longitudinal sectional view taken of the nozzle assembly of the desuperheater device of FIG. 1 illustrating the valve element in an open position.
Figure 2A:
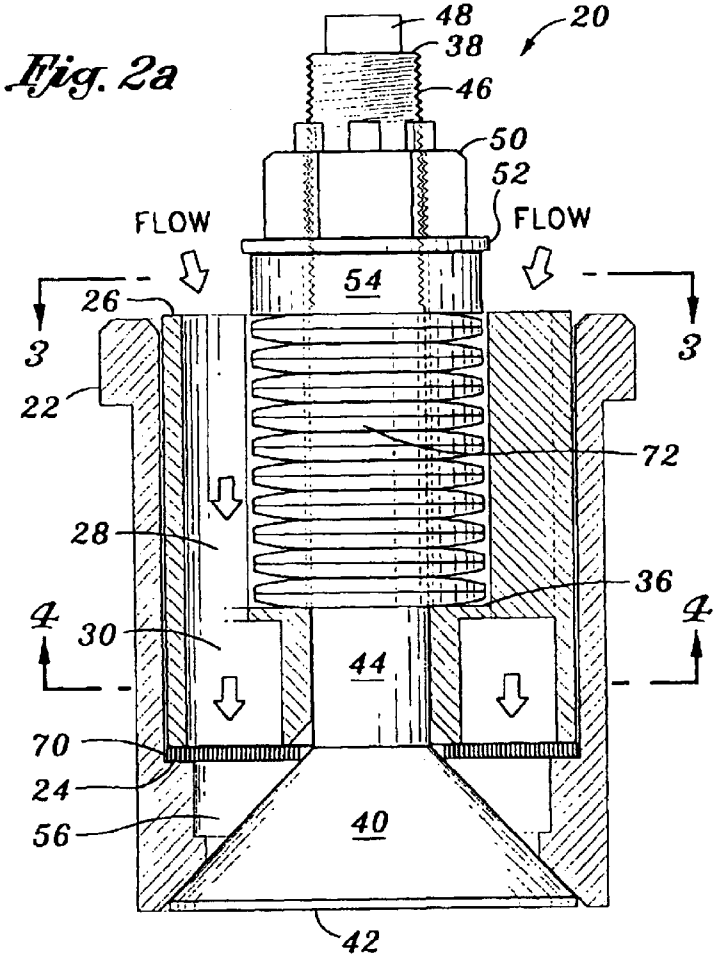
FIG. 2*a* is a longitudinal sectional view taken of the nozzle assembly of the desuperheater device of FIG. 1 illustrating a valve element in a closed position.
Figure 4:
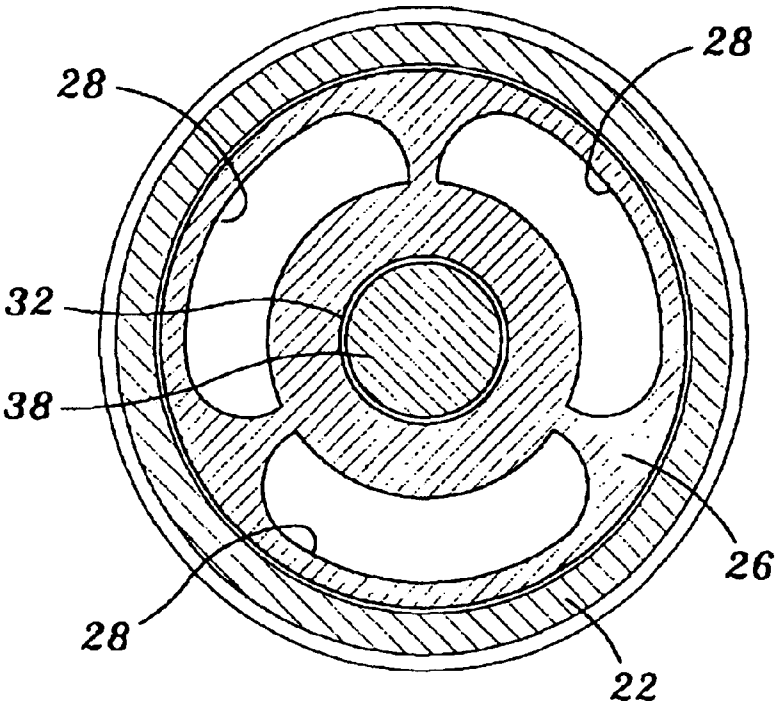
FIG. 4 is an axial sectional view of the nozzle assembly taken along line 4—4 of FIG. 2*a* illustrating flow passages within the nozzle barrel.
Figure 3:
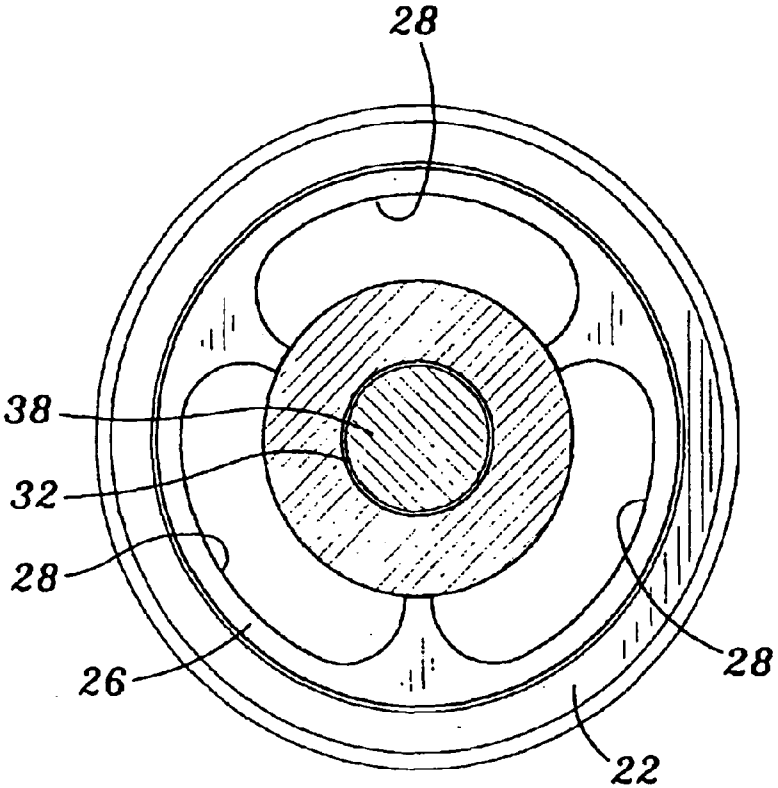
FIG. 3 is an axial sectional view of the nozzle assembly taken along line 3—3 of FIG. 2*a* illustrating the relationship of a nozzle housing and a nozzle barrel that make up the nozzle assembly.

Turning now to FIGS. 2*a*, 2*b*, 3 and 4, shown are sectional and axial views of the nozzle assembly 20 of the desuperheater device 10 of FIG. 1. Shown in FIG. 2*a* is a longitudinal sectional view taken of the nozzle assembly 20 of the desuperheater device 10 of FIG. 1 illustrating a valve element 38 of the nozzle assembly 20 in a closed position. Shown in FIG. 2*b* is a longitudinal sectional view taken of the nozzle assembly 20 of the desuperheater device 10 of FIG. 1 illustrating the valve element 38 in an open position. Shown in FIG. 3 is an axial sectional view of the nozzle assembly 20 taken along line 3—3 of FIG. 2*a* illustrating the relationship of a nozzle housing 22 with a nozzle barrel 26 of the nozzle assembly 20. Shown in FIG. 4 is an axial sectional view of the nozzle assembly 20 taken along line 4—4 of FIG. 2*a* illustrating flow passages 28 within the nozzle barrel 26. The nozzle assembly 20 has a forward and an aft end and includes the nozzle housing 22. As can be seen in FIGS. 3 and 4, the nozzle housing 22 may be configured in a cylindrical shape open at the forward and aft ends and defining an interior nozzle chamber. The nozzle housing 22 of FIGS. 2*a* and 2*b* also defines an interior annular housing shoulder 24 concentrically disposed within the nozzle chamber as shown in FIGS. 2*a* and 2*b*. Although shown in a cylindrical configuration, it is contemplated that the nozzle housing 22 may be configured in any shape that provides a generally hollow configuration open at the forward and aft ends. As was mentioned above, the nozzle housing 22 secures the nozzle assembly 20 to the steam pipe 12. As can be seen in FIGS. 2*a* and 2*b*, the nozzle assembly 20 also includes the nozzle barrel 26 concentrically disposed within the nozzle chamber defined by the nozzle housing 22. The nozzle barrel 26 may be disposed in abutting contact with the housing shoulder 24 proximate the forward end of the nozzle assembly 20. Although not necessary for purposes of the present invention, the aft end of the nozzle barrel 26 is shown as being substantially co-planar with the aft end of the nozzle housing 22.

Figure 5:
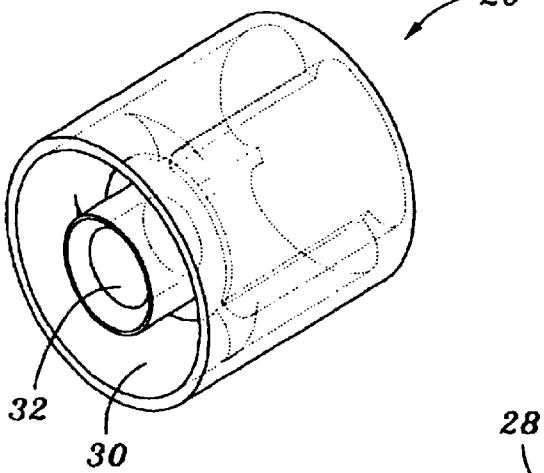
FIG. 5 is a perspective view of the nozzle barrel illustrating a barrel chamber incorporated therein.
Figure 7:
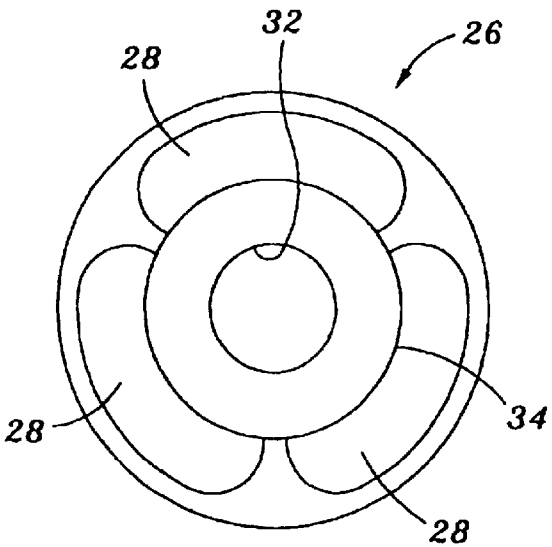
FIG. 7 is an axial sectional view of the nozzle barrel taken along line 7—7 of FIG. 5 illustrating a spring bore and the flow passages incorporated within the nozzle barrel.
Figure 6:
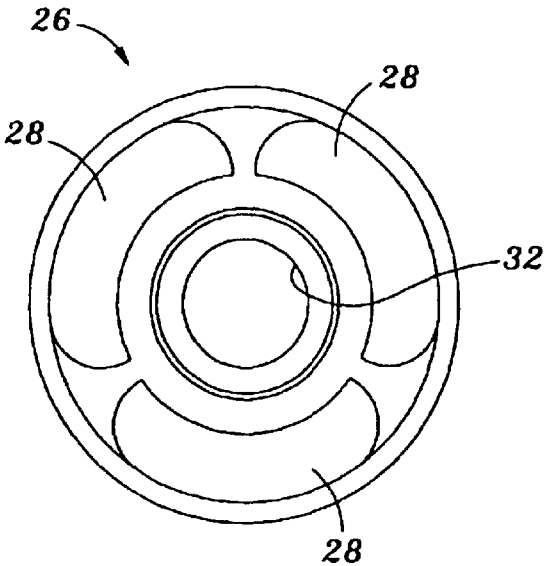
FIG. 6 is an axial sectional view of the nozzle barrel taken along line 6—6 of FIG. 5 illustrating the barrel chamber, a valve stem bore, and flow passages that may be incorporated within the nozzle barrel.

Turning now to FIGS. 5, 6 and 7, shown in more detail is the nozzle barrel 26. FIG. 5 is a perspective view of the nozzle barrel 26 illustrating a barrel chamber 30 defined thereby. FIG. 6 is an axial sectional view of the nozzle barrel 26 taken along line 6—6 of FIG. 5 illustrating the barrel chamber 30, a valve stem bore 32, and flow passages 28 that are disposed within the nozzle barrel 26. FIG. 7 is an axial sectional view of the nozzle barrel 26 taken along line 7—7 of FIG. 5 illustrating the flow passages 28 and a spring bore 34 that may be incorporated within the nozzle barrel 26. As can be seen in FIGS. 5, 6 and 7, the nozzle barrel 26 is shown configured in a cylindrical shape, although it is contemplated that there are many configurations of the nozzle barrel 26 that may be workable. The nozzle barrel 26 includes the valve stem bore 32 and the spring bore 34, both shown concentrically formed through the nozzle barrel 26. The valve stem bore 32 is concentrically formed through the forward end of the nozzle barrel 26. The spring bore 34 is concentrically formed through the aft end of the nozzle barrel 26.

In FIGS. 5, 6 and 7, the diameter of the spring bore 34 is shown as being larger than that of the valve stem bore 32 such that the valve stem bore 32 and the spring bore 34 define an annular barrel shoulder 36 therebetween. Importantly, the nozzle barrel 26 defines an open annular barrel chamber 30 disposed proximate the forward end as shown in FIG. 7. The purpose of the barrel chamber 30 is to minimize or eliminate a tendency for streaming spray of the cooling water out of the nozzle assembly 20. Advantageously, the incorporation of the barrel chamber 30 within the nozzle assembly 20 promotes a geometrically uniform flow pattern for more even mixing of the cooling water spray throughout the flow of superheated steam. Additionally, the barrel chamber 30 promotes the spray of the cooling water in a fine mist or in very small droplets for more effective evaporation within the superheated steam flow. The nozzle barrel 26 may have a plurality of flow passages 28 in fluid communication with the barrel chamber 30. FIGS. 5 and 6 show the nozzle barrel 26 as having three flow passages 28 of arcuate cross-section which extend axially through the nozzle barrel 26 in equidistantly spaced relation to each other. Similar to the advantages provided by the barrel chamber 30, by restricting the number of flow passages 28 to a maximum of only three flow passages 28, the potential for a streaming spray pattern of cooling water may be minimized. Additionally, the configuration of only three flow passages 28 in the barrel chamber 30 promotes the desirable geometrically uniform flow pattern of the cooling water spray. Each flow passage 28 is in fluid communication with the barrel chamber 30 for providing a flow of the cooling water from the aft to the forward end of the nozzle housing 22.

Referring back now to FIGS. 2*a* and 2*b*, also included in the nozzle assembly 20 is a layer of screen mesh 70 having a circular shape disposed between the nozzle barrel 26 and the housing shoulder 24. The screen mesh 70 defines a peripheral portion captured between the housing shoulder 24 and the nozzle barrel 26 in a manner covering the barrel chamber 30. In embodiments of the nozzle assembly 20 that include the screen mesh 70, the nozzle barrel 26 abuts the screen mesh 70, In embodiments that do not include the screen mesh 70, the nozzle barrel 26 abuts the housing shoulder 24. The screen mesh 70 introduces a fine turbulence into the cooling water through the nozzle barrel 26, which assists in the formation of droplets.

As can be seen in FIG. 2*a* and 2*b*, the nozzle assembly 20 also includes a valve element 38 disposed within the nozzle assembly 20. The valve element 38 is slidable within the nozzle barrel 26 with the valve element 38 and the forward end of the nozzle housing 22 collectively defining a flow orifice 58 when the valve element 38 is axially displaced therefrom. The valve element 38 may include a valve stem 44 and a valve head 40. The valve stem 44 has a threaded portion 46 proximate the aft end thereof. The valve head 40 has a truncated conical shape with an end face 42. The truncated conical shape is sealable against the forward end of the nozzle housing 22. The forward end of the nozzle housing 22 may be configured to compliment the tapered surface of the valve head 40, providing improved flow characteristics for the cooling water as it exits the flow orifice 58. It is also contemplated that the configuration of the nozzle housing 22 where it interfaces the valve head 40 may be such that the nozzle housing has a slightly different angle with the valve head such that the velocity of the cooling water increases during its travel through the flow orifice 58, reaching a maximum velocity as it exits the flow orifice 58. Although not necessary, the end face 42 of the valve head 40 may be configured such that the end face 42 is co-planar with the forward end of the nozzle housing 22 in order to minimize the potential for disrupting the flow of superheated steam. The valve stem 44 is configured as an elongate cylinder extending from the valve head 40 through the nozzle barrel 26 and protruding out past the aft end of the nozzle assembly 20. The valve stem 44 is axially slidably carried within the valve stem bore 32 of the nozzle barrel 26. The valve head 40 and the nozzle housing 22 define a pre-valve gallery 56 in the annular volume therebetween. As shown in FIG. 2*b*, the valve head 40 and the nozzle housing 22 collectively define the flow orifice 58 in the annular gap therebetween when the valve head 40 is axially displaced from the forward end of the nozzle housing 22. The conical shape of the valve head 40 is effective to induce a conical spray pattern of the cooling water exiting the flow orifice 58. The valve element 38 is operative to regulate cooling water flow out of the flow orifice 58.

As seen in FIGS. 2*a* and 2*b*, the nozzle assembly 20 may further include at least one valve spring 72 operatively coupled to the valve element 38 for biasing the valve element 38 in sealing engagement against the forward end of the nozzle housing 22. The valve spring 72 abuts the nozzle barrel 26 proximate the aft end thereof and biases the valve element 38 in sealing engagement against the forward end of the nozzle housing 22. Additionally, it is contemplated that the biasing force may be provided by at least one pair of belleville washers slidably mounted on the valve stem 44 in a back to back arrangement within the spring bore 34 and abutting the barrel shoulder 36, as shown in FIGS. 2*a* and 2*b*. Although ten pairs of belleville washers are shown mounted on the valve stem 44 in a back to back arrangement, there may be any number of belleville washers mounted on the valve stem 44.

A spacer 54 may also be included in the nozzle assembly 20, as shown in FIGS. 2*a* and 2*b*. The spacer 54 is mounted on the valve stem 44 within the spring bore 34 and abuts the valve spring 72. Although other shapes, sizes and configurations of the spacer 54 may be workable, the spacer 54 is shown in FIGS. 2*a* and 2*b* configured as a cylinder and sized to slidably bear against the spring bore 34 such that the axial alignment of the valve element 38 is maintained during movement thereof. The thickness of the spacer 54 may be selectively adjustable to limit the relative axial movement of the valve head 40 such that the size of the flow orifice 58 and the flow of cooling water therethrough may be adjusted. In this regard, it is contemplated that for a given configuration of the nozzle assembly 20, spacers 54 of various thickness may be substituted to provide controllability of the relative axial movement and ultimately the size of the flow orifice 58. Additionally, it is contemplated that the spacer 54 may be eliminated altogether from the nozzle assembly 20.

Referring still to FIGS. 2*a* and 2*b*, also included in the nozzle assembly 20 is a valve stop 52 mounted on the valve stem 44. The valve stop 52 may be configured to extend beyond the diameter of the spring bore 34 or valve stem bore 32 for limiting the axial movement of the valve element 38. In FIGS. 2*a* and 2*b*, the valve stop 52 is shown configured as a stop washer mounted on the valve stem 44 and in abutting contact with the spacer 54. The stop washer may have a diameter greater than that of the spring bore 34 for limiting the axial movement of the valve element 38 such that cooling water flow out of the flow orifice 58 may be limited. As further shown in FIGS. 2*a* and 2*b*, the nozzle assembly 20 also includes a load nut 50 threadably attached to the threaded portion 46 of the valve stem 44. The load nut 50 may be adjusted to apply a spring preload to the valve spring 72 by moving the valve stem 44 and the spacer 54 axially relative to each other to squeeze the valve spring 72 between the spacer 54 and the barrel shoulder 36. For configurations of the nozzle assembly 20 that do not include a spacer 54, the adjustment of the load nut 50 squeezes the valve spring 72 between the nozzle barrel 26 and the valve stop 52 or stop washer. For configurations of the nozzle assembly 20 that do not include a valve stop 52 or stop washer, the adjustment of the load nut 50 squeezes the valve spring 72 between the load nut 50 and the nozzle barrel 26 or spring bore 34.

In any case, the load nut 50 may be adjusted to apply a compressive force to the valve head 40 against the nozzle housing 22 for regulating the size of the flow orifice 58. In this regard, the load nut 50 is selectively adjustable to regulate the point at which the pressure of cooling water in the pre-valve gallery 56 against the valve head 40 overcomes the combined pressure of the spring preload and the elevated pressure of the superheated steam against the end face 42. The spring preload is thus transferred to the valve element 38 or valve head 40 against the nozzle housing 22. The amount of linear closing force exerted on the nozzle housing 22 by the valve spring 72 is adjusted by the axial position of the load nut 50 along the threaded portion 46 of the valve stem 44. The valve stem 44 may include at least one pair of diametrically opposed flats 48 formed on the aft end thereof for holding the valve element 38 against rotation during adjustment of the spring preload with the load nut 50. The nozzle assembly 20 may further comprise a locking mechanism for preventing rotation of the load nut 50 after adjustment thereof. Such a locking mechanism may be embodied in a configuration wherein the valve stem 44 has a diametrically disposed cotter pin hole formed through the aft end thereof, and the load nut 50 is a castle nut having at least one pair of diametrically opposed grooves with a cotter pin that extends through the castle nut grooves and the cotter pin hole.

Figure 10:
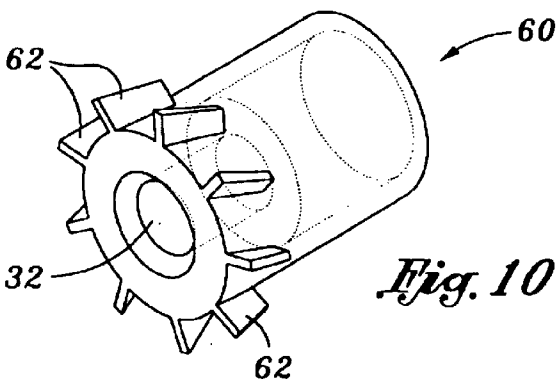
FIG. 10 is a perspective view of the swirl barrel illustrating a plurality of vanes extending radially from an exterior diameter thereof.
Figure 9:
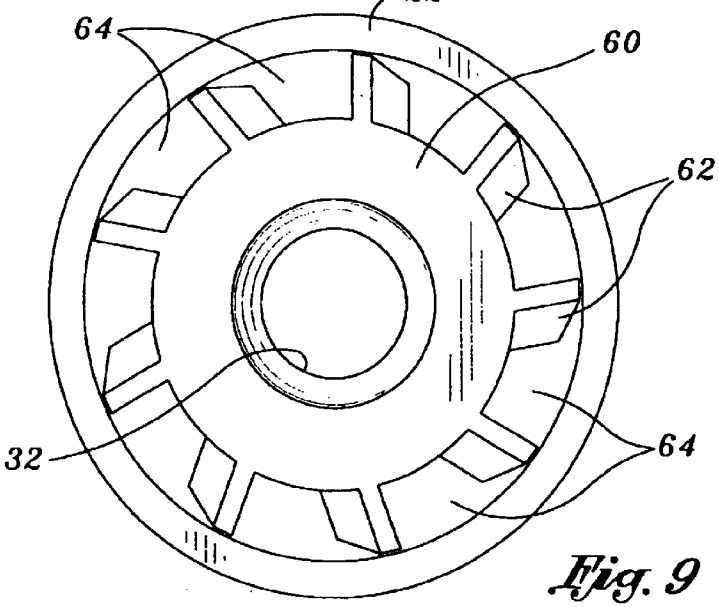
FIG. 9 is an axial sectional view of the nozzle assembly taken along line 9—9 of FIG. 8 illustrating the interrelationship of the swirl barrel with the nozzle housing.
Figure 8:
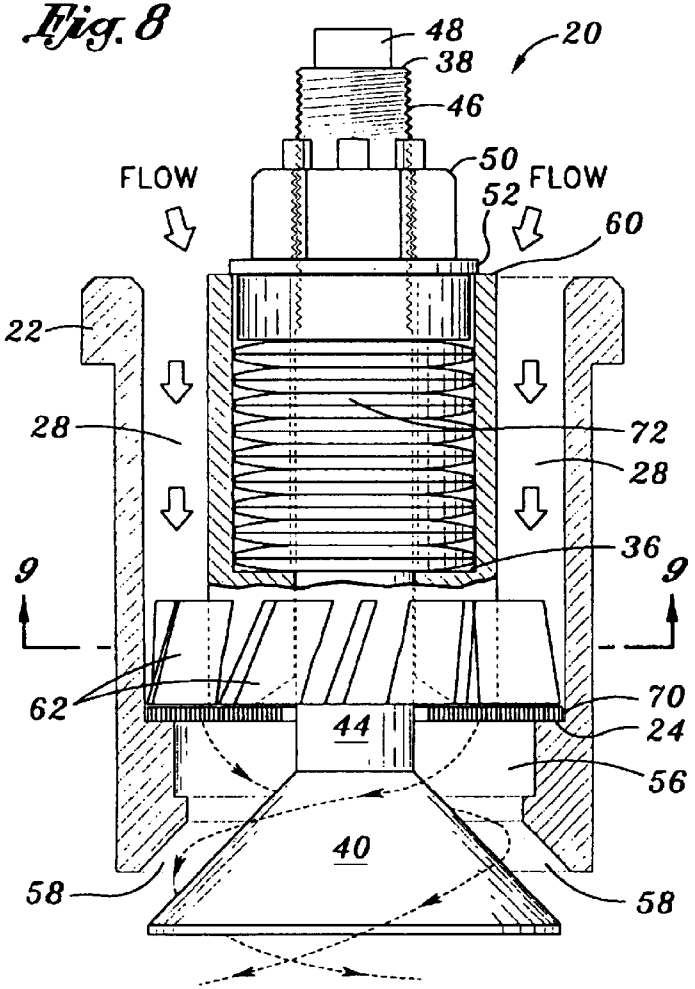
FIG. 8 is a longitudinal sectional view of the nozzle assembly illustrating a swirl barrel disposed therewithin.

Turning now to FIGS. 8, 9 and 10, shown is a nozzle assembly 20 wherein the above-described nozzle barrel 26 is substituted with a swirl barrel 60. FIG. 8 is a longitudinal sectional view of the nozzle assembly 20 illustrating the swirl barrel 60 disposed therewithin. FIG. 9 is an axial sectional view of the nozzle assembly 20 taken along line 9—9 of FIG. 8 illustrating the interrelationship of the swirl barrel 60 with the nozzle housing 22. FIG. 10 is a perspective view of the swirl barrel 60 illustrating a plurality of vanes 62 extending radially from an exterior diameter thereof. The swirl barrel 60 is configured in a cylindrical shape with a diameter less than that of the nozzle chamber of the nozzle housing 22. As seen in FIG. 8, the above-described screen mesh 70 is operatively captured between the distal portions of the vanes 62 and the housing shoulder 24. If the screen mesh 70 is not included in the nozzle assembly 20 including the swirl barrel 60, the distal portions of the vanes 62 will be in direct, abutting contact with the housing shoulder 24.

Notably, the vanes 62 of the swirl barrel 60 are arranged in a circular pattern, extending radially from the exterior diameter of the swirl barrel 60. Collectively, the vanes 62, the barrel chamber 30 and the exterior diameter of the swirl barrel 60 define corresponding channels 64 configured to impart a spiral motion to the cooling water, as can be seen in FIG. 9. In nozzle configurations wherein the swirl barrel 60 is included as an alternative to the nozzle barrel 26, the cooling water exiting the flow orifice 58 defines an expanding helical path about the truncated conical shape of the valve head 40. By imparting a spiral motion to the cooling water prior to discharge out of the flow orifice 58 into the superheated steam flow, the cooling water enters the steam flow in a swirling cone-shaped mist. The geometrically uniform mist pattern ensures a thorough and uniform mixing of the cooling water with the steam flow. The uniform mist pattern also ensures rapid absorption of the cooling water into the superheated steam, increasing the desuperheater efficiency by uniformly controlling the temperature reduction thereof.

Figure 11:
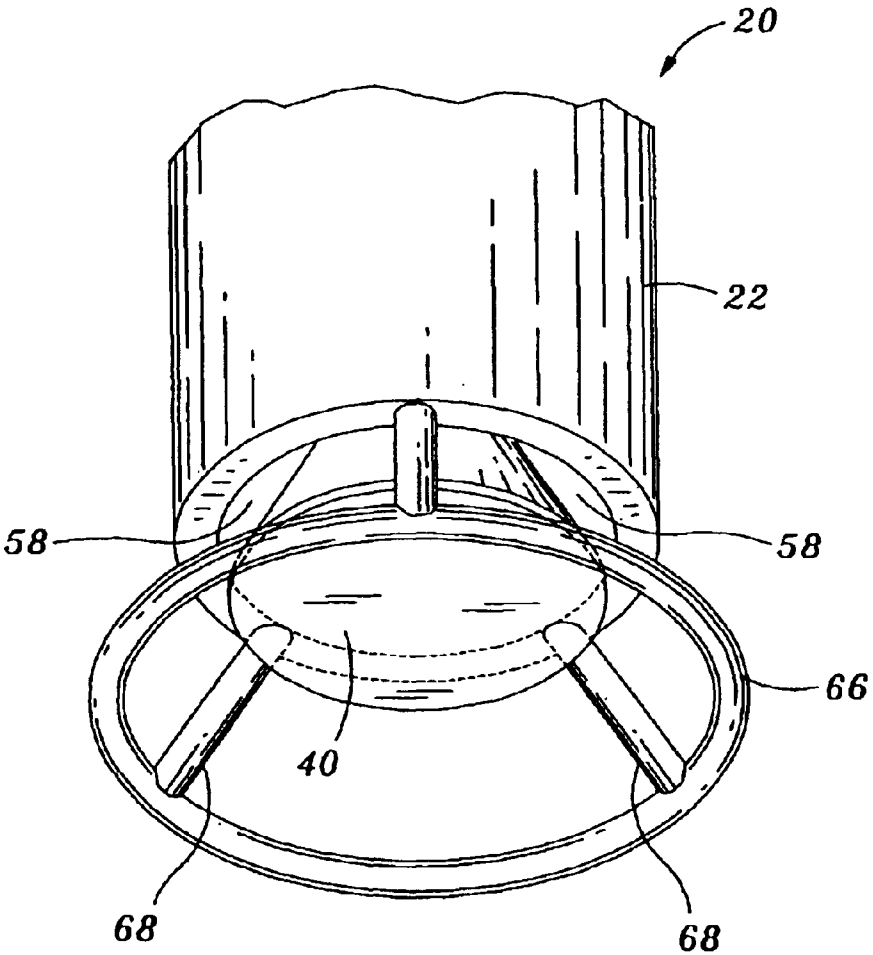
FIG. 11 is a perspective view of a fracture ring disposed adjacent the nozzle housing.

Turning now to FIG. 11, shown is a perspective view of a fracture ring 66 disposed adjacent the nozzle housing 22. The fracture ring 66 is shown having a ring shape and disposed adjacent the forward end of the nozzle housing 22. The fracture ring 66 is positioned adjacent the nozzle housing 22 such that the conical spray pattern of the cooling water exiting the flow orifice 58 impacts the fracture ring 66 for further reducing the droplet size of the cooling water into a fine mist. As was mentioned above, such a fine mist enhances the rapid evaporation of the cooling water by the superheated steam, increasing the desuperheater efficiency. Although FIG. 11 illustrates the fracture ring 66 joined to the forward end of the nozzle housing 22 with a plurality of spokes 68, the spokes 68 being equally spaced about and extending from the circumference of the nozzle housing 22, it will be recognized that there are many configurations for joining the fracture ring 66 to the nozzle housing 22 that may be utilized. Those of ordinary skill in the art will recognize that the fracture ring 66 may be used in conjunction with a nozzle assembly 20 including either the nozzle barrel 26 or the swirl barrel 60.

In operation, as shown in FIG. 1, a flow of superheated steam at elevated pressure passes through the steam pipe 12, to which the nozzle housing 22 is attached. A cooling water feedline 16 provides a supply of cooling water to the nozzle assembly 20. The cooling water feedline 16 is connected to the cooling water control valve 14, which in turn is connected to a suitable high pressure water supply. The control valve 14 controls the flow of cooling water into the cooling water feedline 16 in response to a temperature sensor mounted in the steam pipe 12 downstream of the nozzle assembly 20. The control valve 14 may vary the water flow through the cooling water feedline 16 in order to produce varying water pressure in the nozzle assembly 20.

Cooling water exiting the cooling water feedline 16 passes into the flow passages 28 of the nozzle barrel 26. The cooling water flows through the flow passages 28 at the aft end of the nozzle barrel 26 and into the barrel chamber 30. The barrel chamber 30 minimizes or eliminates a tendency for the cooling water to exit the nozzle assembly 20 in a streaming spray. Advantageously, the barrel chamber 30 promotes a geometrically uniform flow pattern for more even mixing of the cooling water spray throughout the flow of superheated steam. Additionally, the barrel chamber 30 promotes the spray of the cooling water in a fine mist or in very small droplets for more effective evaporation within the superheated steam flow. To further promote the formation of a geometrically uniform fine mist spray of cooling water, the nozzle barrel 26 may have only three flow passages 28 of arcuate cross section. The three flow passages 28 eliminate the tendency for the cooling water to exit the flow orifice 58 in a streaming pattern instead of the more desirable uniform conical spray pattern. The layer of screen mesh 70 may be disposed at the forward end of the nozzle barrel 26. The screen mesh 70 introduces a fine turbulence into the cooling water through the nozzle barrel 26, which assists in the formation of droplets. The cooling water passes through the pre-valve gallery 56, where it bears against the valve head 40 when the nozzle assembly 20 is in the closed position.

As was mentioned above, the adjustment of the load nut 50 squeezes the valve spring 72 to apply a compressive force to the valve head 40 against the nozzle housing 22. In this regard, the spring preload serves to initially hold the nozzle assembly 20 in the closed position, as shown in FIG. 2*a*. The amount of linear closing force exerted on the nozzle housing 22 by the valve spring 72 is adjusted by rotating the load nut 50 along the threaded portion 46 of the valve stem 44. The load nut 50 is selectively adjustable to regulate the point at which the pressure of cooling water in the pre-valve gallery 56 against the valve head 40 overcomes the combined pressure of the spring preload and the elevated pressure of the superheated steam acting against the end face 42. In addition, the setting of the spring preload may be adjusted so as to avoid flashing of the cooling water inside the nozzle assembly 20. Flashing is the sudden vaporization of the cooling water, and can result in damage to the nozzle assembly 20.

When the pressure of the cooling water against the valve head 40 overcomes the combined pressure of the spring preload and the elevated pressure of the superheated steam, the valve head 40 moves axially away from the nozzle housing 22, opening the flow orifice 58, as shown in FIG. 2*b*. Cooling water can then flow through the flow orifice 58 and into the flow of superheated steam. When the control valve 14 increases the water flow through the cooling water feedline 16 in response to a signal from the temperature sensor, an increase in cooling water pressure against the valve head 40 occurs, forcing the valve head 40 linearly away from the nozzle housing 22 and increasing the size of the flow orifice 58. This in turn allows a higher flow of cooling water to pass through the flow orifice 58 and into the superheated steam.

Due to the combination of the truncated conical shape of the valve head 40 and the annular barrel chamber 30 in the nozzle barrel 26, the cooling water enters the steam pipe 12 in a cone-shaped pattern of a fine mist spray consisting of very small water droplets. The addition of the screen mesh 70 introduces a fine turbulence into the cooling water through the nozzle barrel 26. The configuration of the nozzle barrel into three arcuately shaped flow passages 28 as shown in FIGS. 5, 6 and 7 further enhances the production of a fine mist conical spray pattern. Additionally, the substitution of the swirl barrel 60 instead of the nozzle barrel 26, shown in FIGS. 8, 9 and 10, further enhances the geometrically uniform spray pattern. The swirl barrel 60 imparts a spiral motion to the cooling water prior to discharge out of the flow orifice 58 into the superheated steam flow so that the cooling water enters the steam flow in a swirling cone-shaped mist. The geometrically uniform mist pattern ensures a thorough and uniform mixing of the cooling water with the steam flow. The uniform mist pattern maximizes the surface area of the cooling water spray and thus optimizes the desuperheating effect per unit mass of cooling water. The fracture ring 66, shown in FIG. 11, disposed with spokes 68 at the forward end of the nozzle housing 22 and positioned so that the cooling water spray impacts the fracture ring 66 further reduces the droplet size.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A nozzle assembly of a desuperheating device for spraying cooling water into a flow of superheated steam passing through a steam pipe, the nozzle assembly comprising:

a hollow nozzle housing having an open forward end and an open aft end;

a nozzle barrel disposed within the nozzle housing having an open annular barrel chamber disposed proximate the forward end of the nozzle housing, the nozzle barrel having a plurality of flow passages in fluid communication with the barrel chamber for providing a flow of the cooling water from the aft end to the forward end of the nozzle housing;

a valve element slidable within the nozzle barrel, the valve element and the forward end of the nozzle housing collectively defining a flow orifice when the valve element is axially displaced therefrom, the valve element being operative to regulate the flow of cooling water through the flow orifice; and at least one valve spring connected to the valve element for biasing the valve element in sealing engagement against the forward end of the nozzle housing.

2. The nozzle assembly of claim 1 wherein the nozzle barrel has no more than three flow passages of arcuate cross-section, the flow passages extending axially through the nozzle barrel in equidistantly spaced relation to each other and fluidly communicating with the barrel chamber.

3. The nozzle assembly of claim 2 wherein:

the nozzle housing defines an interior annular housing shoulder; and the nozzle assembly further comprises a layer of screen mesh defining a peripheral portion captured between the housing shoulder and the nozzle barrel in a manner covering the barrel chamber.

4. The nozzle assembly of claim 3 wherein:

the barrel chamber and the nozzle barrel are each cylindrically configured;

the layer of screen mesh is circular; and the nozzle barrel and the layer of screen mesh are both concentrically disposed within the nozzle housing.

5. The nozzle assembly of claim 1 wherein the nozzle barrel is a swirl barrel having vanes arranged in a circular pattern, the vanes being configured to impart a spiral motion to the cooling water such that the cooling water exiting the flow orifice defines a helical path about the valve element.

6. The nozzle assembly of claim 5 wherein:

a portion of the valve element is configured in a truncated conical shape;

the swirl barrel is configured in a cylindrical shape with an exterior diameter less than that of the nozzle chamber with the vanes extending radially from the exterior diameter thereof; and the vanes, the nozzle chamber and the exterior diameter of the swirl barrel collectively define corresponding channels configured to impart a spiral motion to the cooling water such that the cooling water exiting the flow orifice defines an expanding helical path about the valve element.

7. The nozzle assembly of claim 1 further comprising a fracture ring disposed adjacent the forward end of the nozzle housing and positioned such that the flow of the cooling water exiting the flow orifice impacts the fracture ring for reducing the droplet size of the cooling water.

8. The nozzle assembly of claim 7 wherein the fracture ring is attached to the forward end of the nozzle housing with a plurality of spokes, the spokes being equally spaced about and extending from the nozzle housing.

9. The nozzle assembly of claim 1 wherein the valve spring comprises at least one pair of belleville washers slidably mounted on the valve element in a back to back arrangement and in abutting contact with the nozzle barrel.

10. A nozzle assembly for a desuperheating device for spraying cooling water into a flow of superheated steam passing through a steam pipe at an elevated pressure, the nozzle assembly comprising:

a cylindrically configured nozzle housing having an open forward end, an open aft end and an interior annular housing shoulder concentrically disposed therein, the nozzle housing securing the nozzle assembly to the steam pipe;

a cylindrically configured nozzle barrel concentrically disposed within and abutting the housing shoulder of the nozzle housing, the nozzle barrel having an open annular barrel chamber disposed proximate the forward end of the nozzle housing, and no more than three flow passages of arcuate cross-section extending axially through the nozzle barrel in equidistantly spaced relation to each other, each of the flow passages fluidly communicating with the barrel chamber for providing a flow of the cooling water from the aft end to the forward end of the nozzle housing;

a valve element concentrically disposed within the nozzle assembly and having a valve head and a valve stem, the valve head being sealable against the forward end of the nozzle housing, with the valve stem extending through the nozzle barrel and protruding past the aft end of the nozzle assembly and having a threaded portion proximate the aft end of the nozzle assembly, the valve head and the nozzle housing collectively defining a flow orifice when the valve head is axially displaced, the valve element being operative to regulate cooling water flow;

at least one valve spring slidably mounted on the valve stem for biasing the valve head against the nozzle housing such that cooling water exiting the flow orifice may be selectively blocked and unblocked;

a valve stop fixedly mounted on the valve stem for limiting the axial movement of the valve element; and a load nut threadably attached to the threaded portion of the valve stem for applying a spring preload to the valve spring.

11. The nozzle assembly of claim 10 further comprising a layer of screen mesh defining a peripheral portion captured between the housing shoulder and the nozzle barrel in a manner covering the barrel chamber.

12. The nozzle assembly of claim 10 wherein the nozzle barrel is a cylindrically configured swirl barrel having vanes arranged in a circular pattern, the vanes extending radially from an exterior diameter thereof, the vanes, the nozzle housing and the exterior diameter of the swirl barrel collectively defining corresponding channels configured to impart a spiral motion to the cooling water such that the cooling water exiting the flow orifice defines an expanding helical path about the valve head.

13. The nozzle assembly of claim 10 further comprising a fracture ring disposed adjacent the forward end of the nozzle housing and positioned such that the flow of the cooling water exiting the flow orifice impacts the fracture ring for reducing the droplet size of the cooling water.

14. The nozzle assembly of claim 13 wherein the fracture ring is joined to the forward end of the nozzle housing with a plurality of spokes, the spokes being equally spaced about and extending from the circumference of the nozzle housing.

15. The nozzle assembly of claim 10 wherein the valve spring comprises at least one pair of belleville washers slidably mounted on the valve stem in a back to back arrangement.

* * * * *